United States Patent [19]

Langlois et al.

[11] 4,390,321

[45] Jun. 28, 1983

[54] CONTROL APPARATUS AND METHOD FOR AN OIL-WELL PUMP ASSEMBLY

[75] Inventors: Henry J. Langlois, Detroit, Mich.; Dean W. Hart, Long Beach, Calif.; Gary J. Blazek, Livonia, Mich.

[73] Assignee: American Davidson, Inc., Darborn, Mich.

[21] Appl. No.: 196,713

[22] Filed: Oct. 14, 1980

[51] Int. Cl.[3] ..... F04B 49/10

[52] U.S. Cl. ..... 417/15; 417/53; 417/223

[58] Field of Search ..... 417/1, 15, 36, 38, 45, 417/46, 47, 53, 223, 319; 60/39.09 R, 223

[56] References Cited

U.S. PATENT DOCUMENTS

| | | | |
|---|---|---|---|
| 3,075,466 | 1/1963 | Agnew et al. | 417/1 X |
| 3,269,320 | 8/1966 | Tilley et al. | 417/1 X |
| 3,807,902 | 4/1974 | Grable et al. | 417/46 |
| 3,965,983 | 6/1976 | Watson | 417/36 X |
| 4,145,161 | 3/1979 | Skinner | 417/45 X |

*Primary Examiner*—Edward K. Look

*Attorney, Agent, or Firm*—Fisher, Gerhardt, Crampton & Groh

[57] ABSTRACT

Control apparatus and method for reducing oil-well pounding and preventing subsequent damage to a producing oil well and an oil-well pump assembly, while maintaining optimum oil-well productivity is disclosed. The control apparatus includes vibration-sensor means operatively coupled to an oil-well pump assembly to detect shock pulses generated by the down-hole pump assembly of the oil well, and including means for transmitting the sensed pulses as equivalent electrical signals to a control means for determining the magnitude and frequency of the vibrations or shock pulses received from the sensor means. Actuator means is operatively coupled to a fluid drive, and is operative in response to the information received from the control means for controlling the speed of the fluid drive to increase or decrease the pump stroke of the oil-well pump assembly depending upon the information received from the control means, whereby optimum oil output is maintained while reducing the pounding to an acceptable level without shutting down the oil well, wherein subsequent damage to the operating oil well and oil-well pump assembly due to pounding is substantially eliminated.

8 Claims, 4 Drawing Figures

CONTROL APPARATUS AND METHOD FOR AN OIL-WELL PUMP ASSEMBLY

BACKGROUND OF THE INVENTION

The invention is directed to a control apparatus and method to maintain optimum oil-well production while reducing the shock pulses encountered during the pump stroke to an acceptable level without shutting down the oil-well pump.

In many oil-producing formations, after the oil level in the well bore is pumped off, that is, only partially filled, a "pounding" condition is encountered. This condition is caused by the reciprocating pump, i.e., the "walking-beam" unit, stroking faster than the flow of oil to the down-hole pump. This allows an air space to develop between the down-hole pump and the column of oil below it. At the next down stroke, the down-hole pump impacts the oil in the well bore and sends a shock wave up through the polished rod, i.e., the "sucker rod", through the reciprocating oil-well pump assembly including the gearbox. When the pounding is allowed to continue without a pump shut-down, the gearbox and other structural failures subsequently occur.

Various control systems have been suggested to prevent damage to the oil-well pump assembly. One such control assembly is disclosed in U.S. Pat. No. 3,269,320. However, in order to prevent damage to the oil well and oil-well pump assembly, the control system automatically shuts down the oil-well pump and oil production ceases. In U.S. Pat. No. 3,306,210, control means is provided which automatically starts and stops the oil-well pump responsive to the presence of oil in the well bore. In U.S. Pat. No. 3,075,466, an automatic motor-control system is described, whereby the pump is shut off when pounding occurs. Thus, the prior art teaches various control means which prevent damage to the oil well and oil-well pump assembly, simply by sensing the shock pulses encountered in the oil-well bore, or sensing the oil level in the well bore and then shutting the pump down in response thereto, thereby curtailing oil production.

SUMMARY OF THE INVENTION

It is an object of the invention to provide a method apparatus for controlling oil-well pounding in the well bore encountered during the pumping stroke, while maintaining the pump speed just at about the threshold when pounding occurs so that optimum oil production is maintained.

Another object of the invention is to provide control means for an oil-well pump assembly which substantially minimizes high current surges caused by heavy starting loads, and reduces the pounding condition to a point at about the threshold when pounding occurs, so that optimum oil production is maintained.

It is a further object of the invention to provide a control means for an oil-well pump assembly in which current surges are damped; permits the use of standard induction motors; reduces starting current; lengthens the operative life of the entire oil-well pump assembly, including the gear-box assembly; substantially eliminates the burning off of "V" belts, and need for changing sheaves, guards and belts; and reduces overall operating maintenance costs and pump-down time.

It is generally contemplated, in accordance with the present invention, to provide a control apparatus and method for reducing oil-well pounding and preventing subsequent damage to a producing oil well and an oil-well pump assembly while maintaining optimum oil-well production. The control apparatus includes vibration-sensor means, operatively coupled to an oil-well pump assembly, to detect shock pulses generated by the down-hole pump assembly of an oil well, including means for transmitting the sensed pulses as equivalent electrical signals to a control means for determining the magnitude and frequency of the vibrations or shock pulses received from the sensor means. Actuator means, coupled to a fluid drive, is operative in response to the information received from the control means to increase or decrease the pump stroke of the oil-well pump assembly, depending upon the information received from the control means, whereby optimum oil output is maintained while reducing the pounding to an acceptable level without shutting down the oil well, wherein subsequent damage to the operating oil well and oil-well pump assembly due to pounding is substantially eliminated.

BRIEF DESCRIPTION OF THE DRAWINGS

The invention herein is described in conjunction with the illustrative embodiment of the accompanying drawing, in which.

DETAILED DESCRIPTION OF THE DRAWINGS

Figure 1:
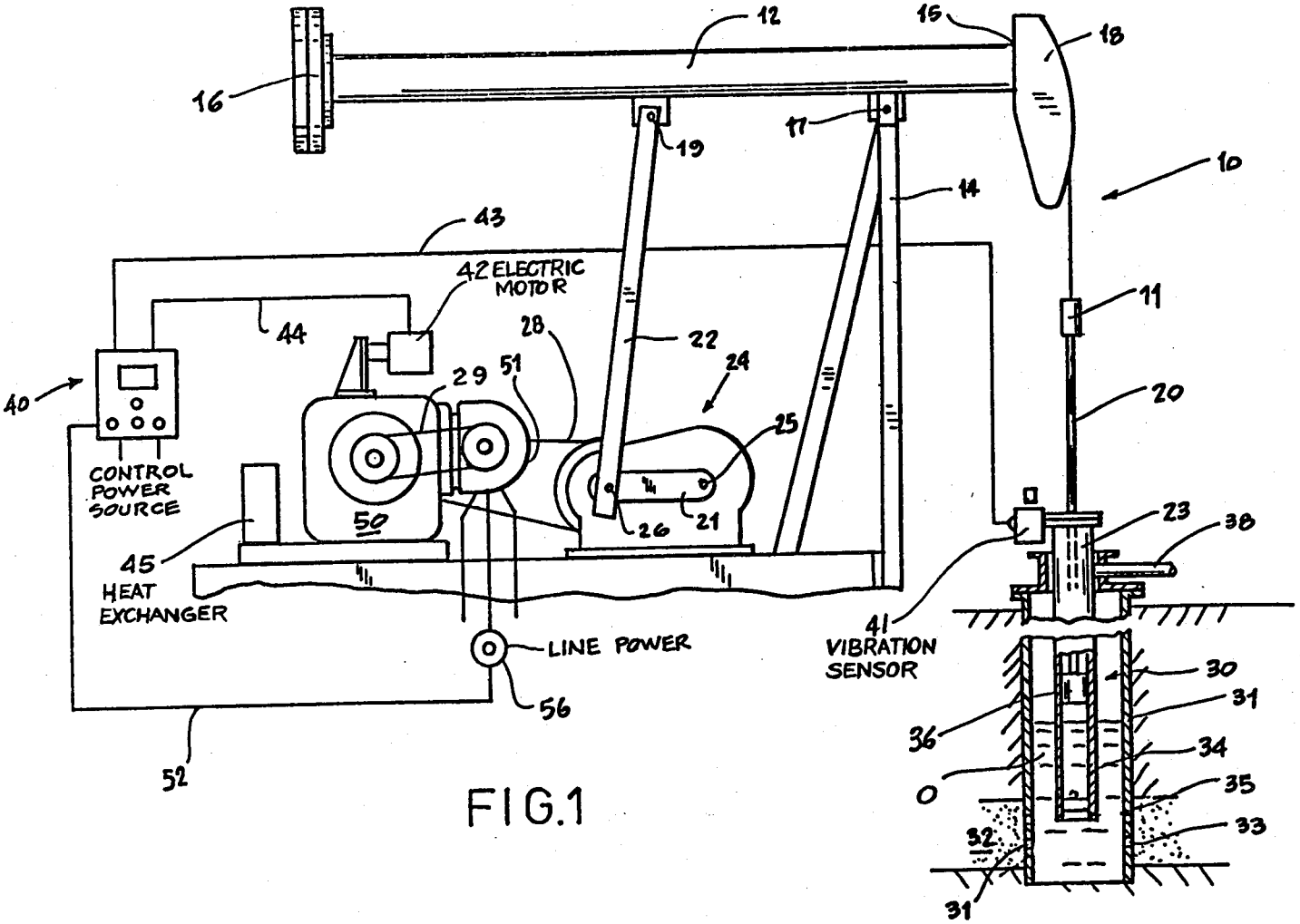
FIG. 1 is a schematic diagram illustrating one embodiment of an oil-well pump assembly of the present invention.

The oil-well pump assembly 10, shown in FIG. 1, includes a conventional pump jack or frame 14 having a walking or rocking beam 12 which is pivotally mounted between its ends 15 and 16 on a frame 14 by pivot pin 17. End 15 includes a "horses head" 18 to which a sucker rod 20 is coupled by bridle 11 and is reciprocated vertically within the down-hole pump assembly 30, to raise the oil "O" to the surface. The operation of the down-hole pump assembly 30 is conventional and is well known in the art such as is shown and described in U.S. Pat. Nos. 3,075,466 and 3,269,320.

Walking beam 12 is reciprocated through linkages 21 and 22. One end of linkage 21 is coupled to gearbox shaft 25, and one end of linkage 22 is pivotally coupled by pivot pin 19 to walking beam 12. The other ends of linkages 21 and 22 are pivotally coupled together by pivot pin 26. Fluid drive 50 is operatively coupled to gearbox 24 by power transmission belt 28 to drive of gearbox 24 which rotates output shaft 25. Linkage 21, which is connected to output shaft 25, will drive linkage 22 to rock beam 12 about pivot pin 17 thereby reciprocating sucker rod 20 to pump oil "O" through outflow pipe 38. The rate of reciprocation of walking beam 12 is controlled by control means 40 which is electrically connected to vibration-sensor means 41 through electrical line 43 and actuator means 42 for controlling the speed of fluid drive 50 through electric line 44. A heat exchanger 45 of an air-to-oil type, such as is sold by American Standard Inc. under the trade name "Fan Ex", serves to cool the oil or other suitable fluid that is used in a fluid drive.

Down hole pump assembly 30 includes a casing 31 which extends into the oil-producing formation 32 so that oil enters through slots or openings 33. Mounted concentrically therein is a tubing 34 which extends into the oil-producing formation 32. The oil passes into tubing 34 through standing valve assembly 35. Sucker rod 20 is coupled to traveling valve assembly 36, which lowers the valve assembly 36 into the oil when walking beam 12 is in the down-stroke position, and will pump the oil to the surface when walking beam 12 is in its up-stroke position. When sucker rod 20 is raised, the oil will be pumped by traveling valve assembly 36 up tubing 34 through out-flow pipe 38.

As depicted in FIG. 1, pounding occurs when the traveling valve 36 is positioned above the oil level in tubing 31 and then on its down stroke, traveling valve 36 will contact or strike the top surface of the oil and, upon impact, pounding occurs. The vibrations generated from the impact of the traveling valve 36 will be conducted along sucker rod 20 until they are picked up by vibration sensor means 41. The vibrations are converted into equivalent electrical signals by vibration-sensor means 41 and are transmitted to control device 40, which then processes the signals and transmits the information as a processed signal to actuator means 42 which is operatively coupled to the fluid drive 50. Actuator means 42 is an electric motor coupled to the scoop tube, not shown, or the fluid drive 50. Depending upon the signal received from control device 40, the scoop tube which is slideably mounted in the fluid drive 50 will be positioned to either increase or decrease the speed of the fluid drive by either increasing or decreasing the amount of oil level in the fluid drive. Thus the speed of the fluid drive can be constantly and infinitely varied depending upon the information received in the form of the processed signal. The processed signal is a summation of the vibration signals received from vibration sensor 41 and transmitted as equivalent electrical signals to actuator means 42 for a preset period of time when oil is being pumped. As the speed of the fluid drive is decreased, output shaft 25 of the gearbox 24 will rotate more slowly, thereby causing walking beam 12 to reciprocate at a slower rate so that the pounding is maintained at about the maximum acceptable level to prevent damage to the gearbox and other parts of the oil-well pump assembly while maintaining maximum oil-well production. The oil-well pump assembly will run continuously without shutdown.

Figure 3:
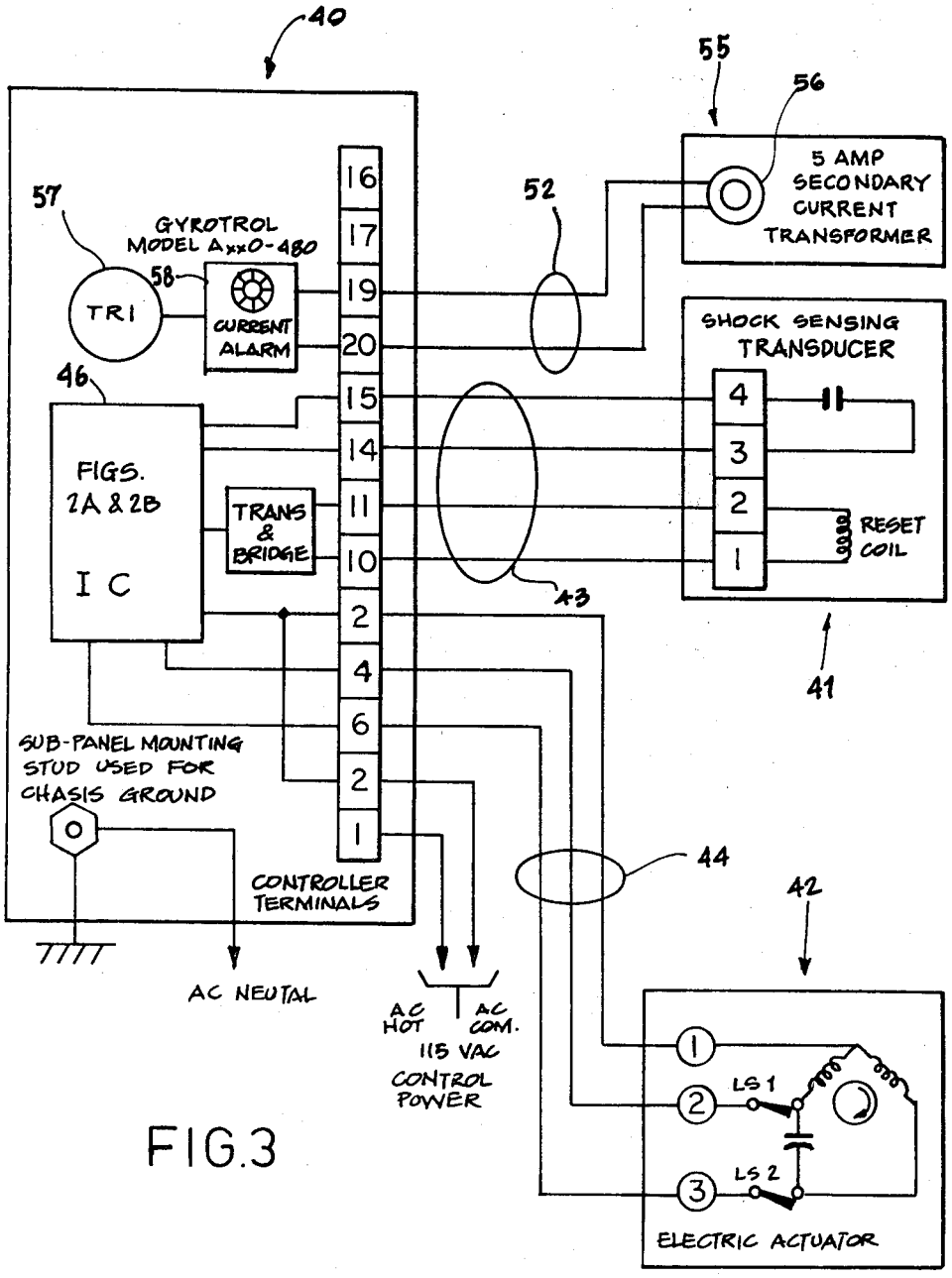
FIG. 3 is a composite electrical schematic diagram of the control means including the torque-limiting circuit for controlling the current overload of a fluid drive motor.

In FIG. 3, automatic torque-limiting circuit 55 is provided as a safety means which will de-clutch fluid drive 50 should a sustained over-torque condition exist such as damage occurring to the oil well, which would freeze the oil-well pump assembly. Also, freezing of the down-hole pump assembly may occur when excessive sand accumulates in the tubing of the down-hole pump, thereby freezing the traveling valve. When such a condition occurs, torque-limiting circuit 55 would be activated and automatically de-clutch fluid drive 50, thereby ceasing all oil-well production until the damage to the pump assembly is corrected.

Torque-limiting circuit 55 includes a 5-amp secondary current transformer 56 which senses the current overload in the 3-phase fluid drive motor 51. The 5-amp transformer is electrically connected to control device 40 through line 52 which senses a current overload condition. One of the three supply wires passes through the doughnut of transformer 56. As the motor current increases, the electrical field around the wire is increased and induces current flow through transformer 56 through line 52. Fluid drive 50 is automatically de-clutched from a sustained over-torque condition, i.e. a motor elevated amperage, as determined by a setting on time delay relay 57, located in control device 40. This setting is determined on the AC current alarm 58. The predetermined setting for each individual oil-well pump assembly is determined by its operation in the field.

Figure 2A:
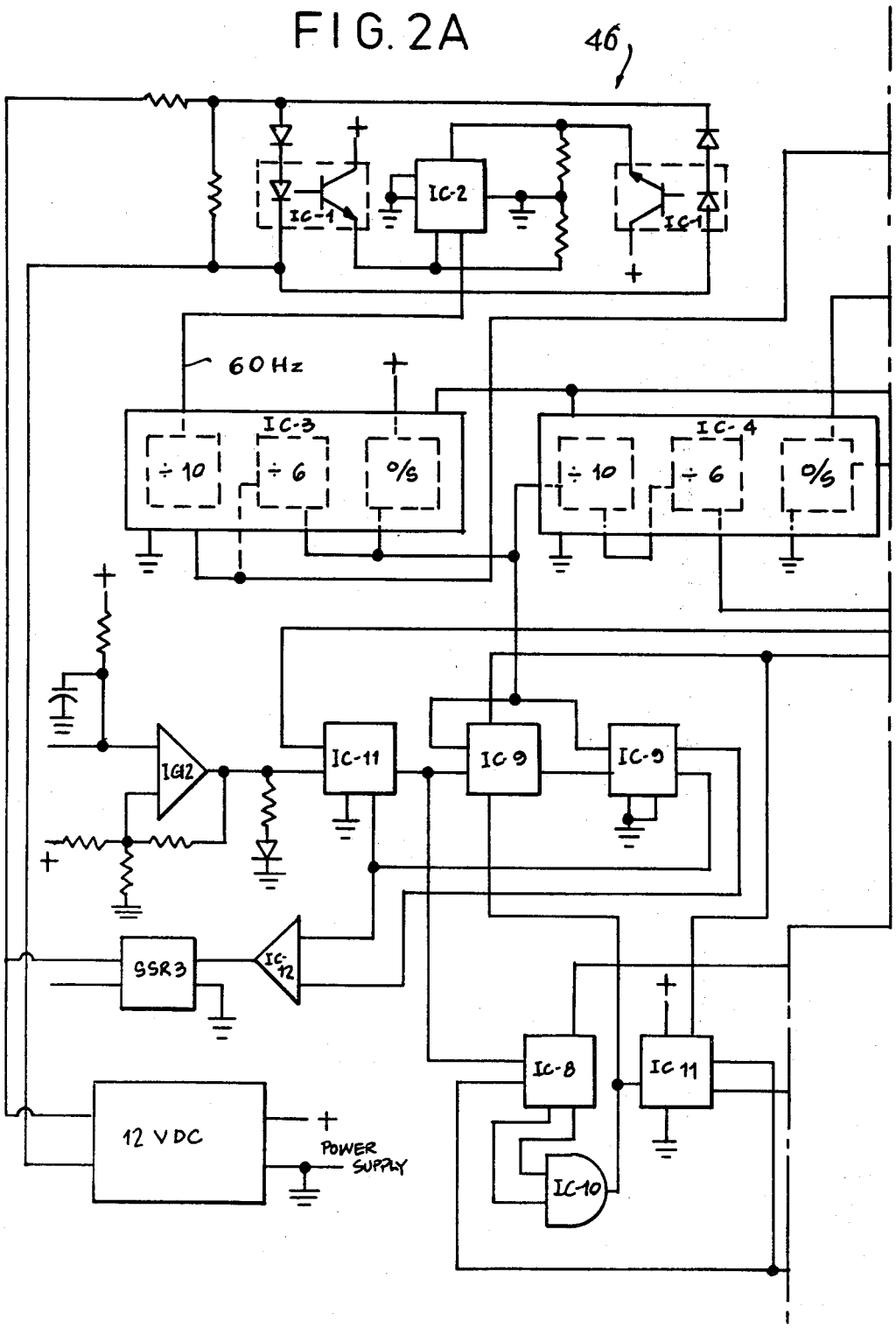
FIGS. 2A and B are electrical schematic diagrams of the solid state control means schematically shown in FIG. 1.
Figure 2B:
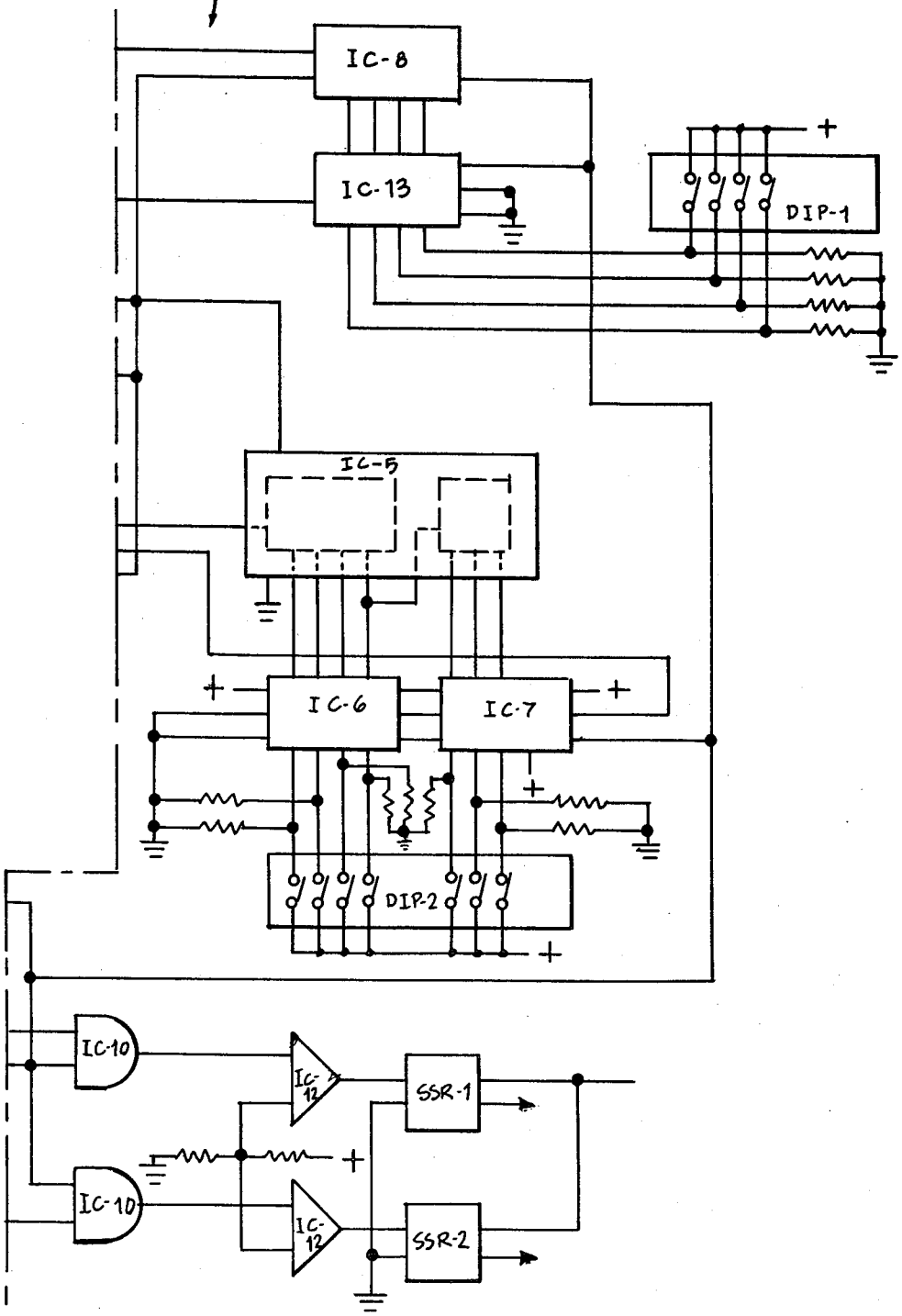

In FIGS. 2A, 2B and 3, there is illustrated an electrical schematic diagram for control device 40 which is utilized to pick up the equivalent electrical pulses transmitted from the vibration-sensor means 41 mounted on well-head 23 of down-hole pump assembly 30. The vibration-sensor means is of a type such as Vibraswitch Malfunction Detector, sold by the Robertshaw Controls Company; Strain Gage Transducer, sold by End Devices Inc.

Solid-state control means 46 consists of a plurality of integrated circuits which are arranged and constructed as indicated in FIGS. 2A and 2B to pick up the sensed shock waves which are converted to equivalent electrical signals transmitted from vibration-sensor means 41 to control means 40, which processes these signals and then transmits the processed electrical signals to speed control actuator 42 through line 44. Depending upon the signal transmitted, speed control actuator 42 will either speed up or slow down fluid drive 50, thus controlling the rate of reciprocation of walking beam 12 through gearbox assembly 24.

Solid-state control means 46 consists of integrated circuits IC-1 and IC-2 which utilizes a 60 Hz line frequency to generate a 60 Hz isolated digital timing pulse. The 60 Hz timing pulse is fed into a first divide by circuit IC-3. As illustrated, the first section of circuit IC-3 is divided by 10 which yields a 1/6th of a second pulse used for correction time control, that is, the correction time control signal when processed through solid-state control means 46 which regulates the movement of the scoop tube of fluid drive 50. The second section of circuit IC-3 divides again by 6 to yield a one second "divide by" circuit consisting of circuit IC-4 which in turn divides by 60 to yield a one minute pulse used for sampling time control.

The correction time or "ON" time circuit consists of IC-8, IC-13, DIP-1, SSR-1, and sections of IC-10 and IC-12 which provides a pulse of 115 volts, A-C power to either the increase or decrease winding of control actuator 42 for a duration of time as determined by the setting onf DIP-1. The sampling time or "OFF" time circuit consists of IC-5, IC-6, IC-7, and DIP-2 in which no correction to the scoop-tube position can be made by control actuator 42, but rather counts excessive vibration pulses transmitted from vibration-sensor means 41 to determine if the next correction time will yield an increase or decrease output to control actuator 42.

The "decision" whether to increase or decrease the speed of fluid drive 50 is made with the vibration switch input-correction circuit consisting of IC-9, SSR-3, and sections of IC-11 and IC-12 in conjunction with a logic count to 10 circuit consisting of IC-8 and sections of circuits IC-10 and IC-11. A condition of excessive vibration exists as a quantity of 10 pulses are sensed during the sampling time duration. The next correction time will then yield a step decrease pulse through to the terminal 6 of control means 40. If less than 10 pulses are sensed during the sampling time duration, the next correction time will yield a step increase pulse through terminal 4 of control means 40.

As is evident, the shock waves received by the vibration-sensor means 41 are transmitted as equivalent electrical signals or pulses to solid-state control means 46. The signals are processed and transmitted from solid-state control means 46 as an electrical signal which determines whether to increase or decrease the speed of the fluid drive 50 through control actuator 42. The speed of the fluid drive will either increase or decrease the speed of output shaft 25 of gearbox 24 and will appropriately either increase or decrease the rate of reciprocation of walking beam 12 through linkages 21 and 22. By controlling the rate of reciprocation of walking beam 12, pounding that is generated by the operation of the down-hole assembly will be maintained at an acceptable level, so that subsequent damage to the oil well and oil-well pump assembly is substantially eliminated.

What is claimed is:

1. A control apparatus for reducing oil-well pounding and preventing subsequent damage to a producing oil well and oil-well pump assembly, said control apparatus comprising:

fluid-drive means operatively coupled to said oil-well pump assembly;

a vibration-sensor means operatively coupled to said oil-well pump assembly to detect shock pulses generated during the pump cycle of said oil-well pump assembly and adapted to transmit the sensed shock pulses in the form of equivalent electrical signals to a control means which uses electric circuitry to determine the frequency of said equivalent electrical signals, and which control means transmits corresponding electrical step increase or step decrease signals as a predetermined electrical signal to an actuator means;

said control means being electrically coupled between said vibration-sensor means and said actuator means, said actuator means being operatively coupled to said fluid-drive means and being continuously responsive to said transmitted predetermined electrical signal from said control means to increase or decrease the rate of the pump stroke of the oil-well pump assembly depending upon said predetermined electrical signal received from said control means whereby optimum oil output is maintained while reducing the pounding to an acceptable level without shutting down the oil well so that subsequent damage to the operating oil well and oil-well pump assembly due to pounding is substantially eliminated.

2. The control apparatus of claim 1 further includes a torque-limiting circuit electrically connected between said oil-well pump assembly and said fluid drive means, said fluid drive including a clutching and declutching means, said torque-limiting circuit being operable to sense a current overload whereby said fluid-drive means is de-clutched to prevent damage to the oil-well pump assembly and said fluid-drive means.

3. A control apparatus for reducing oil-well pounding and preventing subsequent damage to a producing oil well and oil-well pump assembly, said control apparatus comprising:

fluid-drive means operatively coupled to said oil-well pump assembly;

a vibration-sensor means operatively coupled to said oil-well pump assembly to detect shock pulses generated during the pump cycle of said oil-well pump assembly and adapted to transmit the sensed shock pulses in the form of equivalent electrical signals to a control means for determining the magnitude and frequency of said equivalent electrical signals, and means to transmit said equivalent electrical signals as a predetermined electrical signal to an actuator means; said control means including at least a divide by integrated circuit to determine the number of shock pulses received in a predetermined period of time to provide an electrical signal to step increase or decrease the rate of pump stroke of said oil-well pump assembly, said actuator means being operatively coupled to said fluid-drive means and being responsive to said transmitted predetermined electrical signal from said control means to increase or decrease the rate of the pump stroke of the oil-well pump assembly depending upon said predetermined electrical signal received from said control means whereby optimum oil output is maintained while reducing the pounding to an acceptable level without shutting down the oil well so that subsequent damage to the operating oil well and oil-well pump assembly due to pounding is substantially eliminated.

4. The control apparatus of claim 3 wherein said control means further includes sampling time control means coupled to said integrated circuit and operative to count the shock pulses during the predetermined period of time.

5. The control apparatus of claim 4 wherein said control means further includes correction time control means coupled to said integrated circuit and said sampling time control means and operative to develop the electrical signal in accordance with the number of shock pulses counted.

6. The control apparatus of claim 3 wherein said control means further including sampling time control means coupled to said integrated circuit and operative to count the shock pulses during the predetermined period of time and correction time control means operative in response to the number of shock pulses counted to develop the electrical signal in accordance therewith.

7. A method for controlling pounding in an operating oil-well pump assembly without shutting down the oil well comprising:

sensing shock pulses generated by the oil-well pump assembly picked up by a vibration-sensor means and converting said shock pulses into equivalent electrical signals;

transmitting said equivalent electrical signals to a control means, determining at the control means the number of said equivalent signals received in a predetermined period of time by at least a divide by integrated circuit, converting said equivalent electrical signals to an electrical pulse of predetermined magnitude to step increase or step decrease an electrical signal and control the rate of the pump stroke by increasing or decreasing the speed of a fluid-drive means operatively coupled to said oil-well pump, and maintaining continuous and optimum oil output without an oil-well pump shutdown while reducing pounding to an acceptable level wherein subsequent damage to said oil well and oil-well pump assembly due to pounding is substantially eliminated.

8. A fluid-drive control system for driving an oil-well pump assembly having a reciprocating member to pump oil from an oil well comprising:

a control means, a vibration sensor means operably connected to said control means, said control means being operable in response to shock pulses generated by said oil-well pump assembly due to pounding to sense the frequency of the shock pulses and transform said shock pulses into step increase or step decrease signals, said control means sending said signals to an actuator means operably mounted on a fluid drive means, said fluid-drive means being responsive to said actuator means and said fluid drive means being operably connected to said reciprocating member whereby the rate of reciprocation of said reciprocating member is either increased or decreased, so that the pounding is reduced to about a maximum acceptable degree without shutting down the oil well, thereby maintaining optimum oil output.

* * * * *